US008656733B2

(12) United States Patent
Roberts et al.

(10) Patent No.: US 8,656,733 B2
(45) **Date of Patent: *Feb. 25, 2014**

(54) LIQUEFACTION METHOD AND SYSTEM

(71) Applicant: Air Products and Chemicals, Inc., Allentown, PA (US)

(72) Inventors: Mark Julian Roberts, Kempton, PA (US); Adam Adrian Brostow, Emmaus, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/778,772

(22) Filed: Feb. 27, 2013

(65) Prior Publication Data

US 2013/0174603 A1 Jul. 11, 2013

Related U.S. Application Data

(62) Division of application No. 12/272,909, filed on Nov. 18, 2008, now Pat. No. 8,464,551.

(51) Int. Cl.
*F25J 5/00* (2006.01)
*F25J 1/02* (2006.01)

(52) U.S. Cl.
USPC ..... 62/611; 62/612

(58) Field of Classification Search
USPC ..... 62/611, 612, 606, 614, 623
See application file for complete search history.

(56) References Cited

U.S. PATENT DOCUMENTS 3,511,058 A * 5/1970 Becker ..... 62/613
3,616,652 A * 11/1971 Engel ..... 62/613
3,677,019 A * 7/1972 Olszewski ..... 62/613
3,792,590 A * 2/1974 Lofredo et al. ..... 62/614
4,155,729 A * 5/1979 Gray et al. ..... 62/621

(Continued)

FOREIGN PATENT DOCUMENTS

DE 1 501 730 10/1969
DE 101 08 905 A1 2/2001

(Continued)

OTHER PUBLICATIONS

Vink, K.J., et al.; "Comparison of Baseload Liquefaction Processes"; Int'l Conference and Exhibition on Liquefied Natural Gas; No. 12th; May 4, 1998; pp. 3.6/1-15; XP009081893.

(Continued)

*Primary Examiner* — Ljiljana Ciric
*Assistant Examiner* — Alexis Cox
(74) *Attorney, Agent, or Firm* — Eric J. Schaal

(57) ABSTRACT

Liquefaction using a closed loop refrigeration system, including compressing a gaseous refrigerant stream; cooling at least a portion of the compressed gaseous refrigerant stream in a first heat exchanger; expanding a first portion of the cooled, compressed gaseous refrigerant stream from the first heat exchanger to provide a first expanded gaseous refrigerant stream; cooling and substantially liquefying a feed gas stream to form a substantially liquefied feed gas stream in a second heat exchanger through indirect heat exchange against the first portion of the first expanded gaseous refrigerant stream; and further cooling a second portion of the cooled, compressed gaseous refrigerant stream from the first heat exchanger in a third heat exchanger by indirect heat exchange with a second portion of the first expanded gaseous refrigerant stream, wherein the first expanded gaseous refrigerant stream exiting the first expander is substantially vapor.

20 Claims, 13 Drawing Sheets

(56) References Cited

U.S. PATENT DOCUMENTS

| | | | | |
|---|---|---|---|---|
| 4,846,862 | A * | 7/1989 | Cook | 62/48.2 |
| 5,141,543 | A * | 8/1992 | Agrawal et al. | 62/612 |
| 5,768,912 | A * | 6/1998 | Dubar | 62/613 |
| 5,916,260 | A * | 6/1999 | Dubar | 62/613 |
| 6,308,531 | B1 * | 10/2001 | Roberts et al. | 62/611 |
| 6,446,465 | B1 * | 9/2002 | Dubar | 62/613 |
| 6,449,982 | B1 * | 9/2002 | Fischer | 62/613 |
| 6,460,721 | B2 | 10/2002 | Bowen et al. | |
| 7,127,914 | B2 * | 10/2006 | Roberts et al. | 62/612 |
| 7,386,996 | B2 * | 6/2008 | Fredheim et al. | 62/612 |
| 8,181,481 | B2 * | 5/2012 | Jager | 62/612 |
| 2003/0226373 | A1 * | 12/2003 | Prible et al. | 62/612 |
| 2004/0003625 | A1 * | 1/2004 | Fischer et al. | 62/612 |
| 2004/0079107 | A1 * | 4/2004 | Wilkinson et al. | 62/611 |
| 2005/0056051 | A1 * | 3/2005 | Roberts et al. | 62/612 |
| 2007/0227185 | A1 * | 10/2007 | Stone et al. | 62/611 |
| 2008/0141711 | A1 * | 6/2008 | Roberts et al. | 62/611 |
| 2008/0202158 | A1 * | 8/2008 | Rummelhoff et al. | 62/611 |
| 2009/0095019 | A1 * | 4/2009 | Jager | 62/613 |
| 2011/0036121 | A1 * | 2/2011 | Roberts et al. | 62/612 |

FOREIGN PATENT DOCUMENTS

| | | | |
|---|---|---|---|
| DE | 101 47 047 | A1 | 9/2001 |
| DE | 10-2006-039889 | A1 | 2/2008 |
| FR | 2 873 192 | A1 | 1/2006 |
| JP | 02-106688 | | 4/1990 |
| JP | 10-501053 | | 1/1998 |
| JP | 2001-226685 | | 8/2001 |
| WO | 95/27179 | | 10/1995 |
| WO | 01/69149 | A1 | 9/2001 |
| WO | 2005/071333 | A1 | 8/2005 |
| WO | 2009/017414 | A1 | 2/2009 |
| WO | 2009/072900 | A1 | 6/2009 |
| WO | 2009/130466 | A2 | 10/2009 |
| WO | 2011/018686 | A2 | 2/2011 |

OTHER PUBLICATIONS

Dubar, Chris, et al., "A Competitive Offshore LNG Scheme Utilising a Gravity Base Structure and Improved Nitrogen Cycle Process", LNG-12—Twelfth International Conference & Exhibition on Liquefied Natural Gas, Perth, Austrailia, May 4-7, 1998.

* cited by examiner

LIQUEFACTION METHOD AND SYSTEM

CROSS-REFERENCE TO RELATED APPLICATIONS

The present application is a divisional application and claims the benefit of priority of U.S. application Ser. No. 12/272,909, filed Nov. 18, 2008.

BACKGROUND

Liquefaction methods and systems where refrigeration is generated by expanding gaseous refrigerant in a reverse-Brayton cycle are known. These methods and systems typically employ two expanders where the gaseous refrigerant is expanded to substantially the same pressure within tolerance of the pressure drop through equipment. Some systems also include more than two expanders with the cold expander discharge pressure being higher than the discharge pressures of the remaining expanders. These methods and systems have potentially simple compression systems because there are no streams introduced between compression stages, and simple heat exchangers because there are less passages and headers. Further some methods and systems use an open-loop system that utilizes the liquefied fluid as a refrigerant.

The previous methods and systems for liquefaction, however, are problematic for several reasons. For example, using simple compression systems and simple heat exchangers fails to result in improved efficiencies. Moreover, the cost savings in using an open-loop system does not outweigh the flexibility of using a closed-loop system.

There is a need for a method and system for liquefaction where the steps of precooling, liquefaction, and subcooling are more safe, efficient, and reliable.

BRIEF SUMMARY

Embodiments of the present invention satisfy this need in the art by providing a safe, efficient, and reliable system and process for liquefaction, and specifically for natural gas liquefaction.

According to one exemplary embodiment, a method for liquefaction is disclosed using a closed loop refrigeration system, the method comprising the steps of (a) compressing a gaseous refrigerant stream in at least one compressor; (b) cooling the compressed gaseous refrigerant stream in a first heat exchanger; (c) expanding at least a first portion of the cooled, compressed gaseous refrigerant stream from the first heat exchanger in a first expander to provide a first expanded gaseous refrigerant stream; and (d) cooling and substantially liquefying a feed gas stream to form a substantially liquefied feed gas stream in a second heat exchanger through indirect heat exchange against at least a first portion of the first expanded gaseous refrigerant stream from the first expander, wherein the first expanded gaseous refrigerant stream exiting the first expander is substantially vapor.

According to another exemplary embodiment, a method of liquefaction is disclosed using a closed loop refrigeration system, the method comprising the steps of: (a) compressing a gaseous refrigerant stream in a low pressure compressor; (b) further compressing the compressed gaseous refrigerant stream in a high pressure compressor; (c) cooling the compressed gaseous refrigerant stream in a first heat exchanger; (d) expanding at least a first portion of the cooled, compressed gaseous refrigerant stream from the first heat exchanger in a first expander to provide a first expanded gaseous refrigerant stream, wherein the first expanded gaseous refrigerant stream from the first expander provides cooling to a second heat exchanger and the first heat exchanger; (e) cooling and substantially liquefying a feed gas stream through indirect heat exchange against the first expanded gaseous refrigerant stream from the first expander in the second heat exchanger and the first heat exchanger; and (f) subcooling the cooled and substantially liquefied feed gas stream through indirect heat exchange against a second expanded gaseous refrigerant stream exiting a second expander in a subcooler exchanger, wherein the first expanded gaseous refrigerant stream exiting the first expander and the second expanded gaseous refrigerant stream exiting the second expander are substantially vapor, and wherein the pressure of the second expanded gaseous refrigerant stream is lower than the pressure of the first expanded gaseous refrigerant stream.

According to yet another exemplary embodiment, a closed loop system for liquefaction is disclosed, comprising: a refrigeration circuit, the refrigeration circuit comprising: a first heat exchanger; a second heat exchanger fluidly coupled to the first heat exchanger; a first expander fluidly coupled to the first heat exchanger and adapted to accept a stream of refrigerant from the first heat exchanger; a second expander fluidly coupled to the second heat exchanger and adapted to accept a stream of refrigerant from the second heat exchanger; and a third heat exchanger fluidly coupled to the first expander and adapted to accept a first expanded gaseous refrigerant stream from the first expander and a feed gas stream, wherein the first expanded gaseous refrigerant stream from the first expander and the second expanded gaseous refrigerant stream from the second expander are substantially a vapor stream.

According to another exemplary embodiment, a method of liquefaction of a gaseous feed is disclosed using a closed-loop vapor expansion cycle having at least two expanders, wherein the discharge pressure of a second expander is lower than the discharge pressure of a first expander, and wherein the first expander provides at least a portion of the refrigeration required to liquefy the gaseous feed.

BRIEF DESCRIPTION OF THE DRAWINGS

The foregoing brief summary, as well as the following detailed description of exemplary embodiments, is better understood when read in conjunction with the appended drawings. For the purpose of illustrating embodiments of the invention, there is shown in the drawings exemplary constructions of the invention; however, the invention is not limited to the specific methods and instrumentalities disclosed. In the drawings.

DETAILED DESCRIPTION

Figure 1:
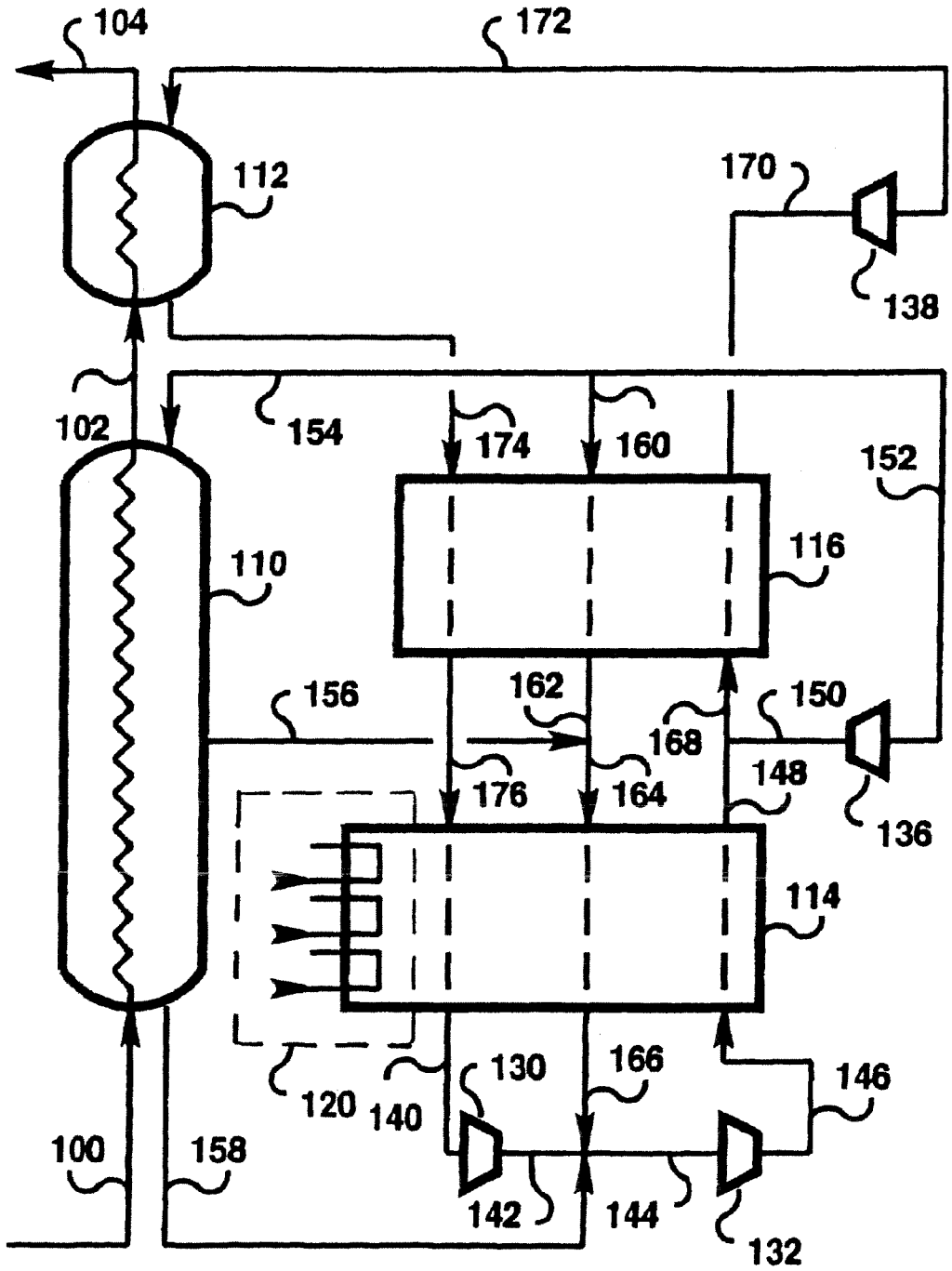
FIG. 1 is a flow chart illustrating an exemplary gas liquefaction system and method involving aspects of the present invention.

In one exemplary embodiment, the liquefaction process may use two expanders and the gaseous refrigerant streams exiting the two expanders may be substantially vapor at the discharge of each expander. The term "expander" may hereby be used to describe a device such as a centrifugal turbine or a reciprocating expander that expands gas while producing external work. The process may be substantially isentropic and is often called work expansion or reversible adiabatic expansion and different from isenthalpic (Joule-Thompson) throttling through a valve.

The cold expander's discharge pressure may be lower than the warm(est) expander's discharge pressure to achieve colder temperatures. The gaseous refrigerant from the discharge of the cold expander may be used to subcool the liquefied product. The refrigerant from the discharge of the warm(est) expander may be used for liquefaction. Use of two different pressures may better match the cooling curve of natural gas liquefaction (i.e., precooling, liquefaction, and subcooling), for example. The gaseous refrigerant stream from the discharge of the warm(est) expander may be introduced between the stages of the gaseous refrigerant compressor. The feed gas stream and/or gaseous refrigerant may be precooled by another refrigerant such as propane, for example, in a closed-loop compression cycle. The feed gas stream and/or gaseous refrigerant may also be precooled by a gaseous refrigerant from a third expander, for example.

In another exemplary embodiment, the gaseous refrigerant stream from the discharge of the warm(est) expander may be compressed to the final discharge pressure in a separate compressor with a suction pressure higher than that of the compressor used to compress the gas originating from the discharge of the cold expander.

The feed gas stream and/or refrigerant may be precooled, for example, by the vaporizing liquid refrigerant such as $CO_2$, methane, propane, butane, iso-butane, propylene, ethane, ethylene, R22, HFC refrigerants, including, but not limited to, R410A, R134A, R507, R23, or combinations thereof, for example. Environmentally friendly fluorinated hydrocarbons and their mixtures may be preferred for off-shore or floating applications. For example, $CO_2$ may be used as refrigerant. $CO_2$ precooling minimizes the physical footprint, especially for offshore Floating Production Storage and Offloading (FPSO) applications.

The liquid refrigerant may be vaporized at different pressures in a series of heat exchangers, compressed in a multistage compressor, condensed, and throttled to appropriate pressures to be revaporized. With a proper seal system, the compressor's suction pressure may be kept at vacuum to allow for cooling to lower temperatures. Alternatively, the feed gas stream and/or gaseous refrigerant may be precooled by expanding the same gaseous refrigerant in a third expander.

In another exemplary embodiment, the feed gas stream may be cooled by indirect heat exchange with the gaseous refrigerant in the first set of heat exchangers comprising at least one exchanger in which the gas is not cooled. The gaseous refrigerant may be cooled in the second set of heat exchangers comprising at least one exchanger. The first set of heat exchangers may comprise wound-coil heat exchangers, for example. The second set of heat exchangers may comprise plate-and-fin brazed aluminum (core) type heat exchangers, for example.

In yet another exemplary embodiment, the feed gas stream may be cooled in a heat exchanger from which a portion of the gaseous refrigerant may be withdrawn at an intermediate point, preferable between the precooling and liquefaction sections. Gaseous refrigerant may be precooled by vaporizing liquid refrigerant in a heat exchanger belonging to the second set of heat exchangers. Such refrigerant may be a fluorinated hydrocarbon or $CO_2$, for example.

In another exemplary embodiment, the feed gas stream may be precooled against vaporizing liquid refrigerant in a serious of kettles or shell-and-tube heat exchanges. A portion of gaseous refrigerant may also be cooled in multi-stream heat exchanger belonging to the second set of heat exchangers. Another portion of gaseous refrigerant may be cooled to about the same temperature against vaporizing liquid refrigerant in a serious of kettles or shell-and-tube heat exchanges which may be separate or combined with the heat exchangers used for precooling the feed gas stream.

Now referring to the specific figures, various embodiments may be employed. In one exemplary embodiment, and as illustrated in FIG. 1, a feed gas stream 100, for example, may be cooled and liquefied against a warming gaseous refrigerant stream 154 of nitrogen, for example, in a heat exchanger 110.

The feed gas stream 100 may be natural gas, for example. While the liquefaction system and method disclosed herein may be used for liquefaction of gases other than natural gas and thus, the feed gas stream 100 may be a gas other than natural gas, the remaining exemplary embodiments will refer to the feed gas stream 100 as a natural gas stream for illustrative purposes.

A portion (stream 156) of the partially warmed stream 154 may be withdrawn from the heat exchanger 110 to balance the precooling (warm) section of the heat exchanger 110 that requires less refrigeration. Gaseous refrigerant stream 158 may leave the warm end of heat exchanger 110, for example, to be recycled.

Substantially liquefied natural gas (LNG) stream 102, for example, exiting the cold end of the heat exchanger 110 may be subcooled in subcooler exchanger 112 against warming gaseous refrigerant stream 172 and, after exiting the cold end of subcooler exchanger 112, recovered as liquefied natural gas product 104, for example. Gaseous refrigerant stream 174 may leave the warm end of subcooler exchanger 112.

Gaseous low-pressure refrigerant stream 140 may be compressed in the low-pressure refrigerant compressor 130. The resulting stream 142 may be combined with streams 158 and 166 and may enter the high-pressure refrigerant compressor 132 as stream 144. The low pressure refrigerant compressor 130 and the high-pressure refrigerant compressor 132 may include aftercoolers and intercoolers that cool against an ambient heat sink. The heat sink may be, for example, cooling water from a water tower, sea water, fresh water, or air. Intercoolers and aftercoolers are not shown for simplicity.

High-pressure refrigerant stream 146 from the discharge of high-pressure refrigerant compressor 132 may be cooled in heat exchanger 114. The resulting stream 148 may be split into streams 150 and 168.

Stream 150 may be expanded in expander 136 to produce stream 152. Expander 136 may be a vapor expander, for example. A vapor expander is any expander where the discharge is substantially vapor (i.e., where the discharge stream is 80% vapor). Stream 152 may be distributed between heat exchanger 110 (above-mentioned stream 154) and heat exchanger 116 as stream 160. Stream 160 may be warmed in heat exchanger 116. Resulting stream 162 may be combined with stream 156 from heat exchanger 110. Resulting stream 164 may be further warmed in heat exchanger 114 to produce stream 166.

Stream 168 may be cooled in heat exchanger 116. The resulting stream 170 may be expanded in expander 138 to produce the above-mentioned stream 172 which may then be warmed in subcooler exchanger 112. Expander 138 may be a vapor expander, for example. The resulting stream 174 may be further warmed in heat exchanger 116 to produce stream 176. Stream 176 may be further warmed in heat exchanger 114 to produce stream 140.

Heat exchanger 114 may be cooled with refrigeration system 120 that comprises at least one stage of vaporizing liquid refrigerant such as, $CO_2$, methane, propane, butane, iso-butane, propylene, ethane, ethylene, R22, HFC refrigerants, including, but not limited to, R410A, R134A, R507, R23, or combinations thereof, for example. Use of $CO_2$ as a liquid refrigerant for precooling is thought to minimize the physical footprint, especially for Floating Production Storage and Offloading (FPSO) applications. Other refrigeration cycles using gaseous refrigerant may also be employed.

Heat exchangers 114, 116 may be combined into one exchanger, for example. Heat exchangers 114, 116 may also be plate-and-fin brazed aluminum (core) type heat exchangers, for example.

Heat exchangers 110, 112 may be combined or mounted on top of one another, for example. Heat exchangers 110, 112 may be of plate-and-fin brazed aluminum (core) type heat exchangers, for example. Heat exchangers 110, 112 may also be wound coil type heat exchangers that assure better safety, durability, and reliability, for example. Robust type heat exchanges may be used to cool natural gas, for example, because the cooling of natural gas involves a phase change that may cause more significant thermal stresses on the heat exchangers. Wound coil heat exchangers may be used because they are generally less susceptible to thermal stresses during phase change, contain leaks better than core type heat exchangers, and are generally impervious to mercury corrosion. Wound coil heat exchangers also may offer lower refrigerant pressure drop on the shell side, for example.

Refrigerant compressors 132, 134 may be driven by electric motors or directly driven by one or more gas turbine drivers, for example. Electricity can be derived from a gas turbine and/or a steam turbine with a generator, for example.

Part of the compression duty of refrigerant compressors 132, 134 may be derived from expanders 136, 138. This usually means that at least one stage of sequential compression, or, in the case of a single-stage compression, the entire compressor or compressors in parallel are directly or indirectly driven by expanders. Direct drive usually means a common shaft while indirect drive involves use of a gear box, for example.

In FIGS. 2-5 and 8-11, elements and fluid streams that correspond to elements and fluid streams in the embodiment illustrated in FIG. 1 or the other respective embodiments have been identified by the same number for simplicity.

Figure 2:
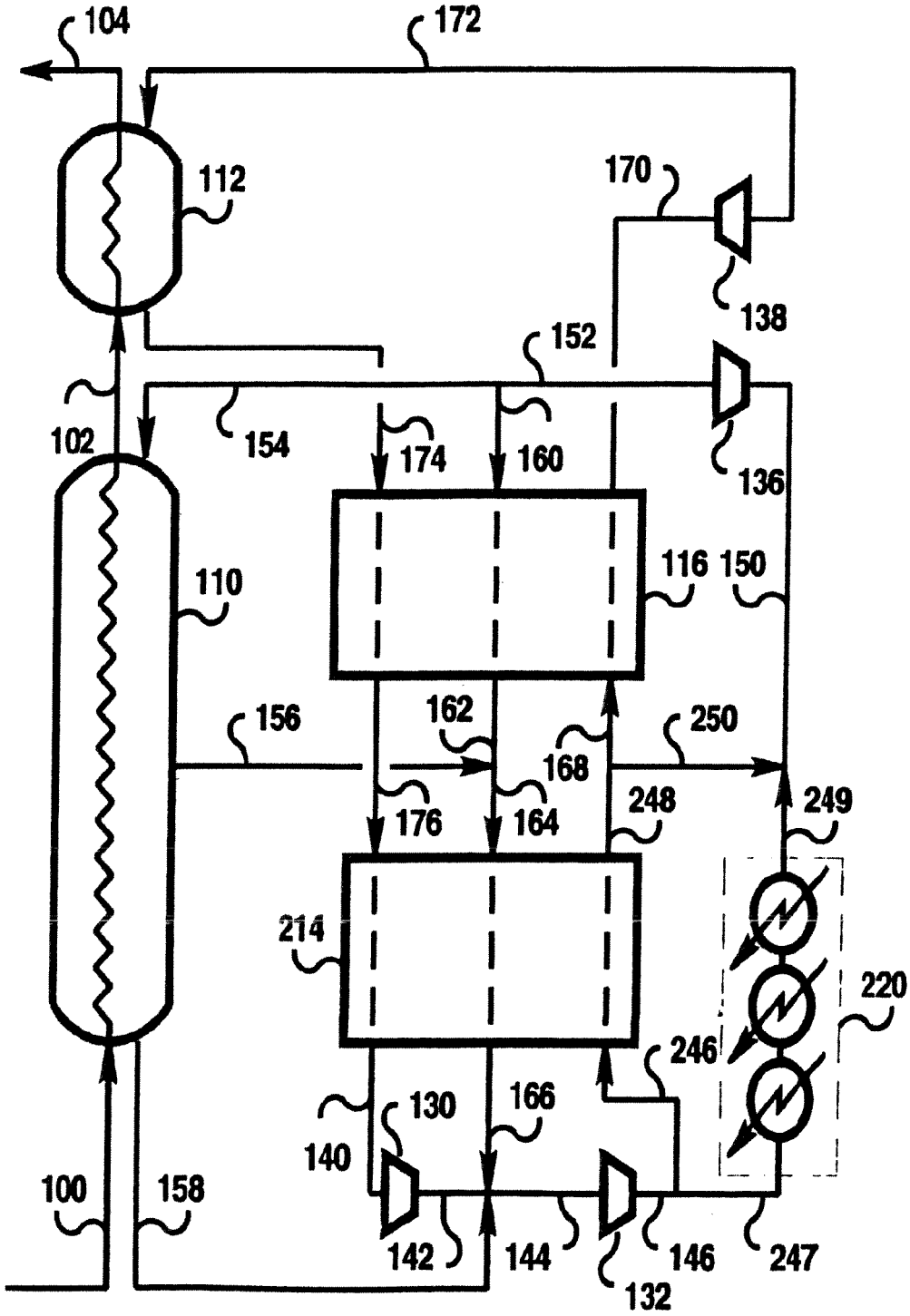
FIG. 2 is a flow chart illustrating an exemplary gas liquefaction system and method involving aspects of the present invention.
Figure 6:
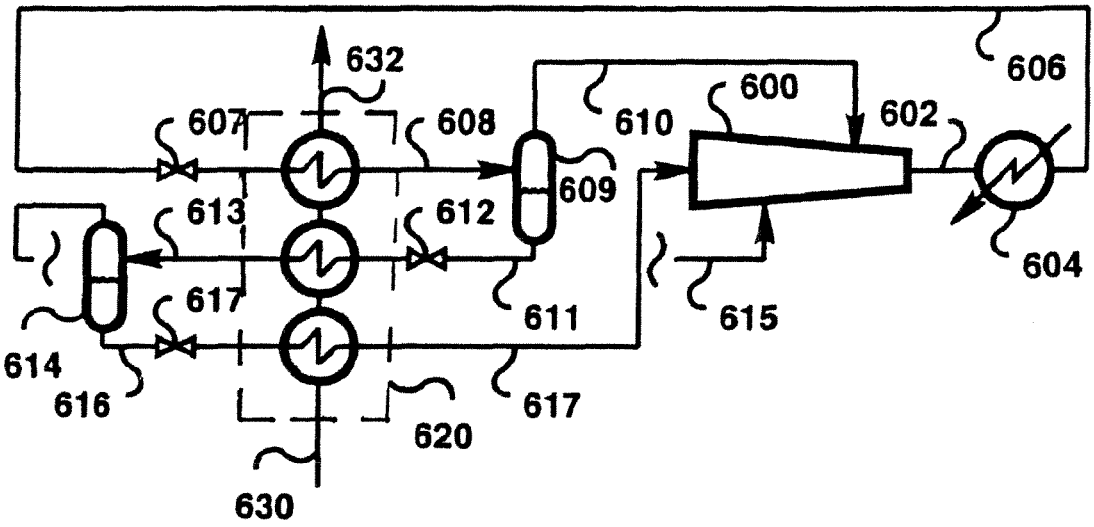
FIG. 6 is a flow chart illustrating an exemplary precooling refrigeration system and method involving aspects of the present invention.

In another exemplary embodiment, and as illustrated in FIG. 2, stream 146 from the discharge of high-pressure refrigerant compressor 132 is divided into two streams 246, 247. Stream 246 is cooled in heat exchanger 214 to produce stream 248 which is divided into streams 168 and 250. Stream 247 bypasses heat exchanger 214 and is cooled in refrigeration system 220 that comprises at least one stage of vaporizing liquid refrigerant. Vaporization may take place in kettles, for example, such as shell-and-tube heat exchangers with boiling refrigerant on the shell side as illustrated in FIG. 6. Resulting stream 249 is combined with stream 250 to form stream 150 that enters expander 136.

Figure 3:
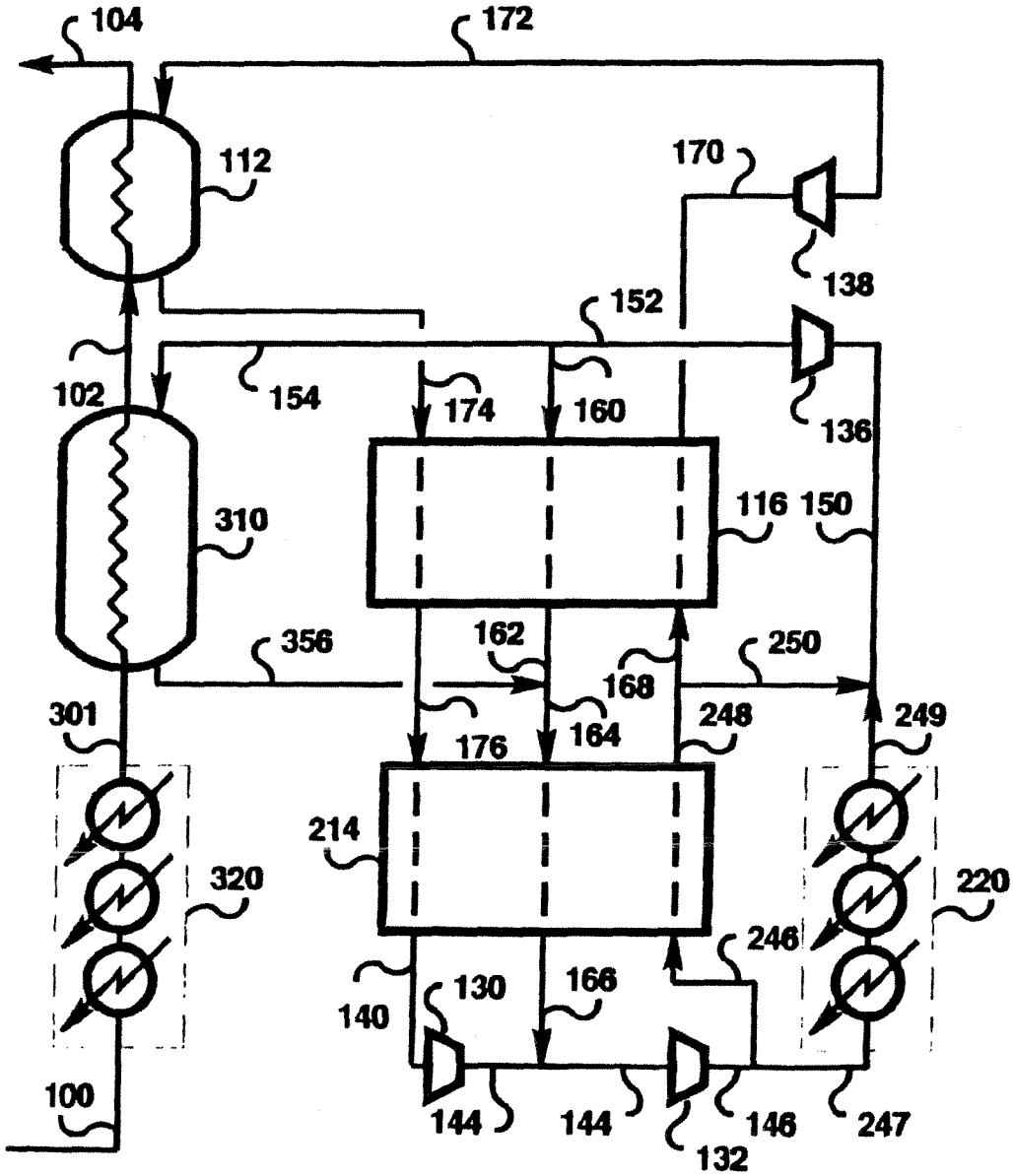
FIG. 3 is a flow chart illustrating an exemplary gas liquefaction system and method involving aspects of the present invention.

In yet another exemplary embodiment, and as illustrated in FIG. 3, natural gas feed stream 100, for example, may be precooled in the refrigeration system 320 that comprises at least one stage of vaporizing liquid refrigerant. The resulting stream 301 may be liquefied in heat exchanger 310 to produce substantially liquid stream 102. Gaseous refrigerant from 310, stream 356, may be combined with stream 162, like stream 156 in FIGS. 1 and 2.

Refrigeration systems 320 and 220 may be combined into one refrigeration system, for example, with the liquid refrigerant boiling on the shell side of the series of heat exchangers and both natural gas and vapor refrigerant streams cooled in tube circuits, for example. The refrigerant compressor and condenser are preferably common to both systems as illustrated in FIG. 6.

Figure 4:
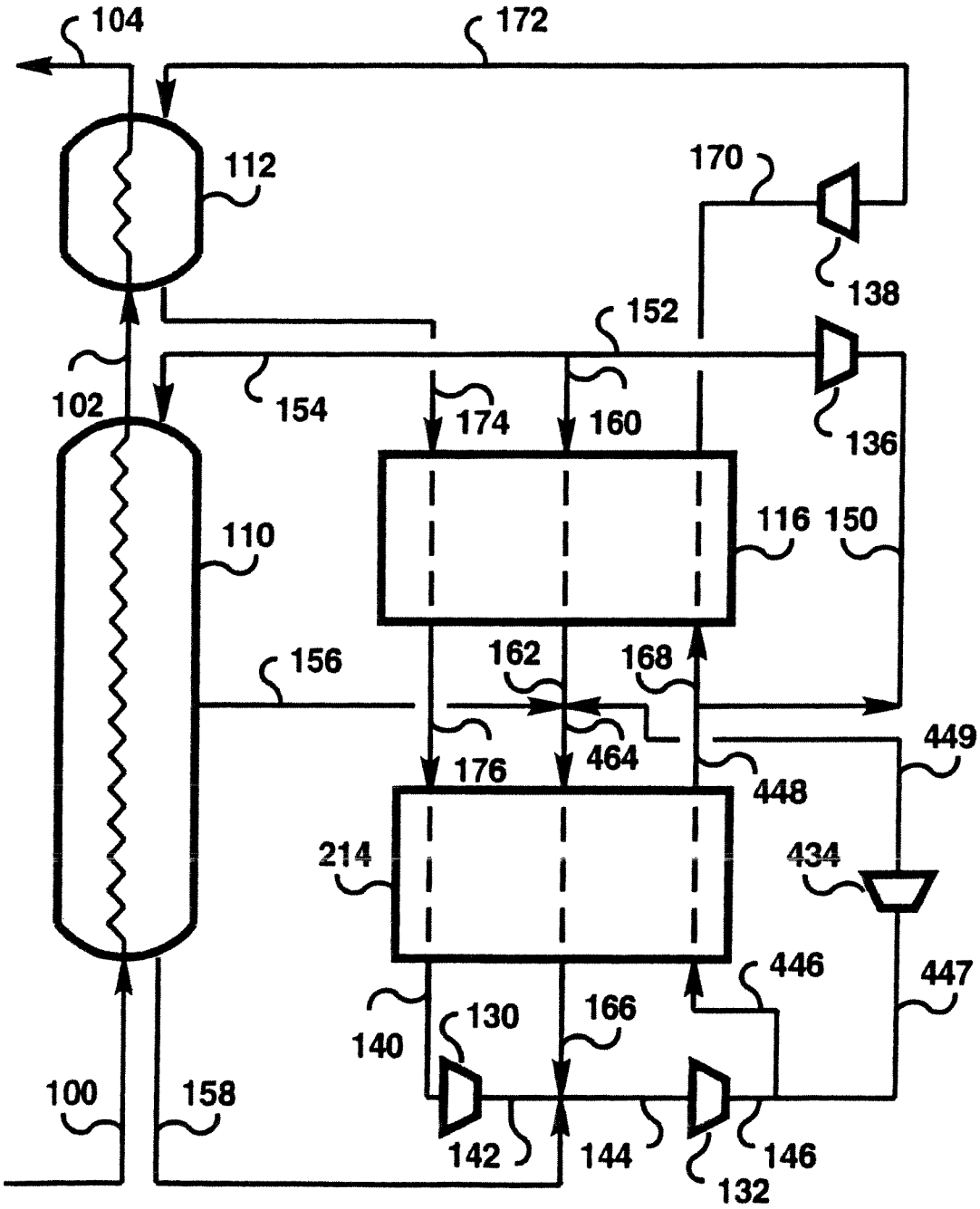
FIG. 4 is a flow chart illustrating an exemplary gas liquefaction system and method involving aspects of the present invention.

In yet another exemplary embodiment, and as illustrated in FIG. 4, stream 146 may be divided into two streams 446, 447. Stream 446 may be cooled in heat exchanger 214 to produce stream 448. Stream 447 may bypasses heat exchanger 214 and may be expanded in expander 434. Resulting stream 449 may be combined with streams 156 and 162 to form stream 464 that may enter heat exchanger 214 in the same manner as stream 164 in FIGS. 1 and 2.

Figure 5:
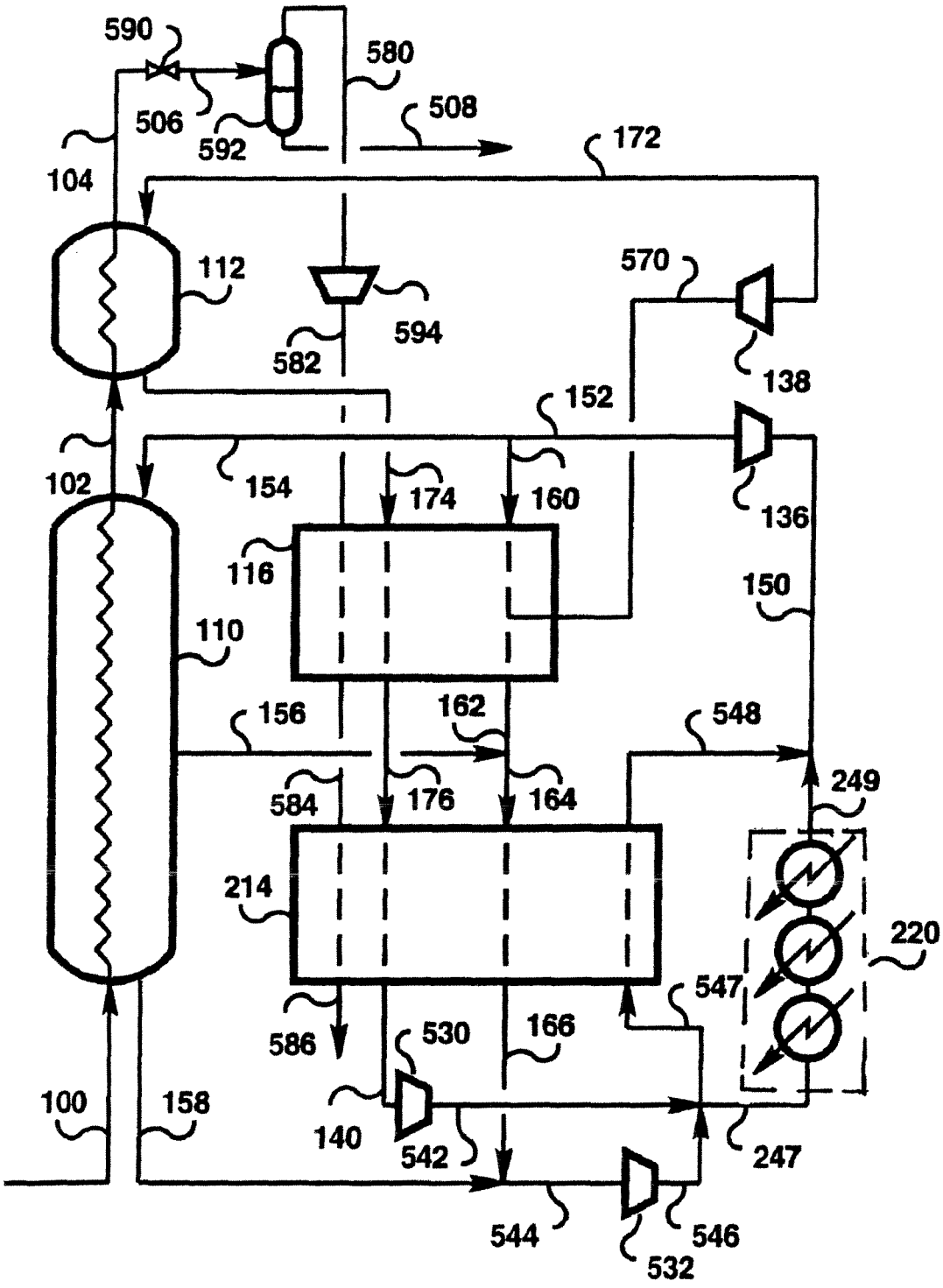
FIG. 5 is a flow chart illustrating an exemplary gas liquefaction system and method involving aspects of the present invention.

In another exemplary embodiment, and as illustrated in FIG. 5, the expansion may be accomplished in a sequential manner. Stream 548 may be combined with stream 249 to produce stream 150 which may be expanded in expander 136. A portion of stream 160 may be partially warmed in heat exchanger 116 (stream 570) and may be expanded in expander 138. Therefore, the inlet pressure to expander 138 may be close to the discharge pressure of expander 136.

Stream 166 may be introduced between the stages of the gaseous refrigerant compressors or may be combined with stream 158 to produce stream 544 which is compressed in a separate compressor 532 to produce stream 546. In that case, stream 140 may be compressed in compressor 530 to produce stream 542 at the same pressure as stream 546. The choice of configuration may depend on compressor fit and the associated costs. Combined streams 542 and 546 may be split into stream 547 and 247. Stream 547 may be cooled in heat exchanger 214 to produce stream 548, and as illustrated in FIG. 2, stream 247 may bypass heat exchanger 214 and may be cooled in refrigeration system 220.

The subcooled product 104 may be throttled to a lower pressure in valve 590 The resulting stream 506 may be partially vapor. Valve 590 may be replaced with a hydraulic turbine, for example. Stream 506 may be separated into liquid product 508 and flash vapor 580 in phase separator 592. Stream 580 may be cold-compressed in compressor 594 to produce stream 582 that may be at a temperature close to the temperature of streams 160 and 174. In the alternative, stream 580 may also be warmed up in subcooler exchanger 112 or in a separate heat exchanger against a portion of stream 102.

Stream 582 may be warmed in heat exchanger 116 to produce stream 584 which may be further warmed in heat exchanger 114 to produce stream 586. Stream 586 may be typically compressed to a higher pressure and used as fuel for one or more generator(s), steam turbine(s), gas turbine(s), or electrical motor(s) for power generation, for example.

The three modifications illustrated in FIG. 5 (sequential expansion, parallel gaseous fuel compressor, and recovering refrigeration from flash gas) may also be applicable to configurations shown in the other exemplary embodiments.

FIG. 6 illustrates an exemplary embodiment of the precooling refrigeration system depicted in FIGS. 1-3 and 5. Stream 630, which may be a gaseous refrigerant and/or a natural gas feed, may be cooled in heat exchange system 620 (corresponding to systems 120, 220, and 320 on previous figures) to yield stream 632.

The gaseous refrigerant may be compressed in refrigerant compressor 600. Resulting stream 602 may be totally condensed in condenser 604. Liquid stream 606 may be throttled in valve 607 and partially vaporized in the high-pressure evaporator of heat exchange system 620 to produce two-phase stream 608, which may then be separated in phase separator 609. The vapor portion 610 may be introduced between the stages of 600 as a high-pressure stream. The liquid portion 611 may be throttled in valve 612 and partially vaporized in the medium-pressure evaporator of heat exchange system 620 to produce two-phase stream 613, which may then be separated in phase separator 614. The vapor portion 615 may be introduced between the stages of 600 as a medium-pressure stream. The liquid portion 616 may be throttled in valve 617, totally vaporized in the low-pressure evaporator of heat exchange system 620, and introduced between the stages of 600 as a low-pressure stream 617. Therefore, refrigeration may be supplied at three temperature levels corresponding to the three evaporator pressures. It also possible to have more or less than three evaporators and temperature/pressure levels.

Stream 602 may be supercritical at a pressure higher than the critical pressure, for example. It may then be cooled in condenser 604 without phase change to produce a dense fluid 606. Supercritical stream 606 may become a partial liquid after being throttled.

Figure 7A:
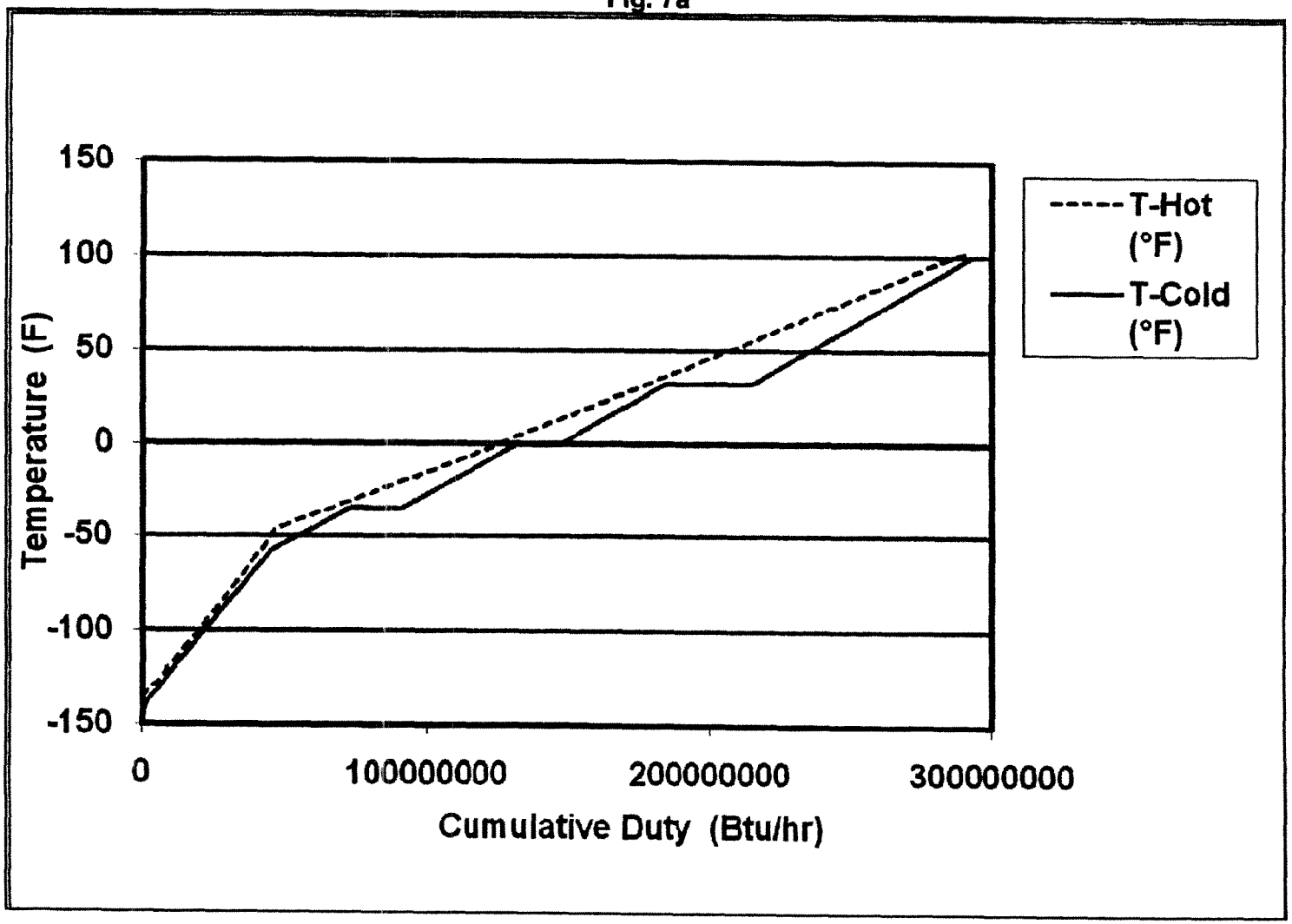
FIG. 7*a* is graphical illustration of the cooling curves in accordance with an embodiment of the present invention.
Figure 7B:
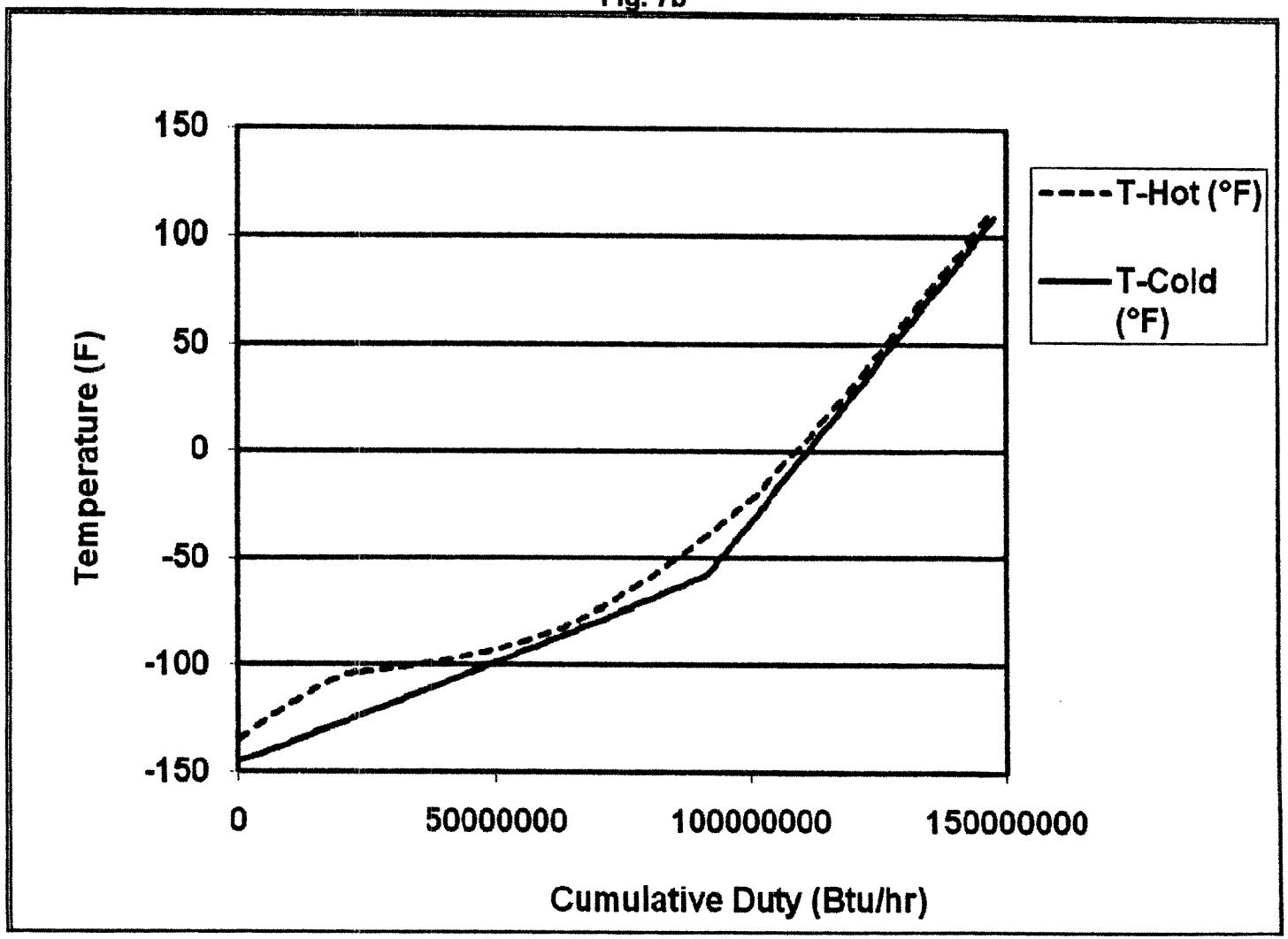
FIG. 7*b* is graphical illustration of the cooling curves in accordance with an embodiment of the present invention.
Figure 7C:
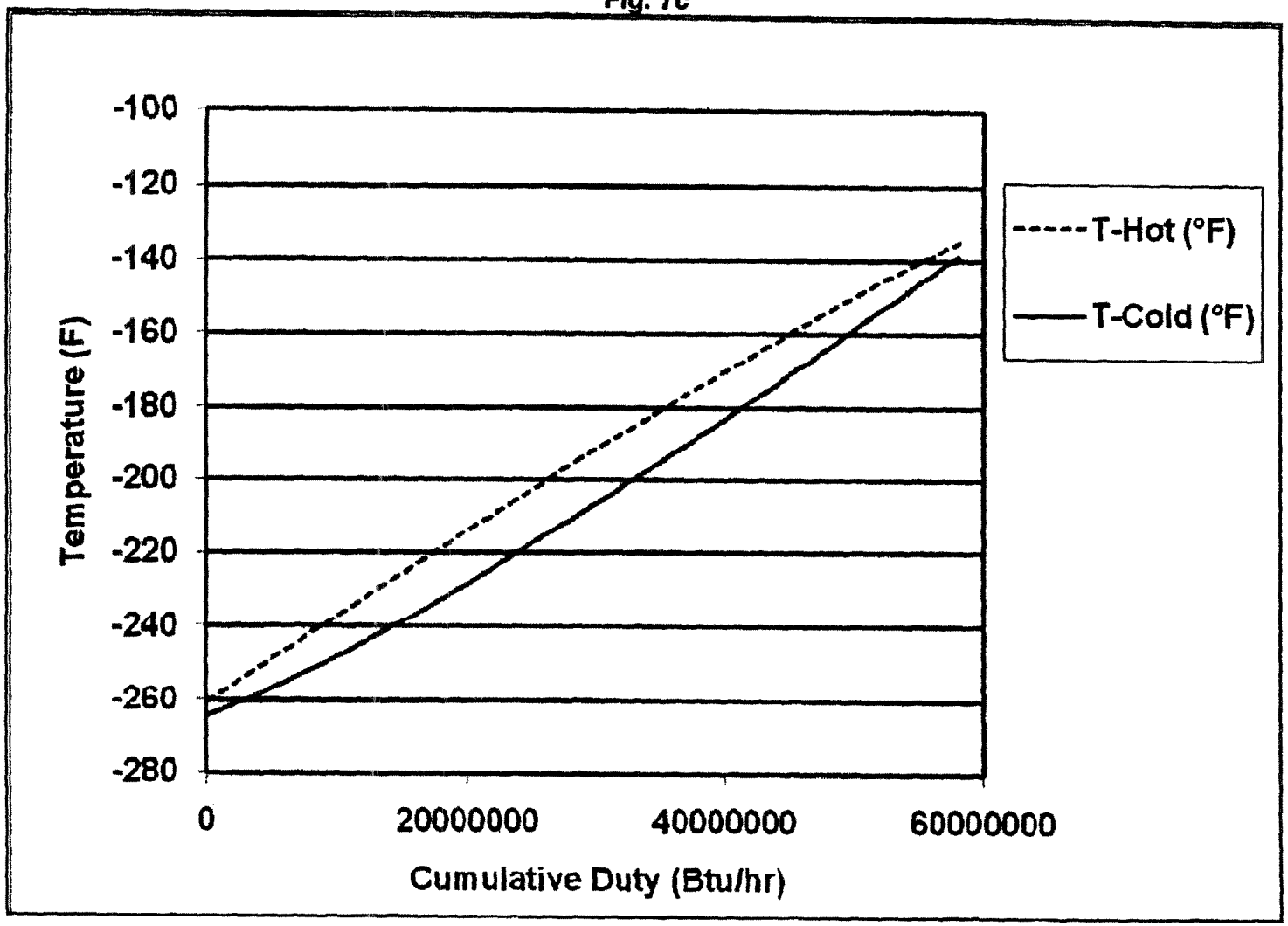
FIG. 7*c* is graphical illustration of the cooling curves in accordance with an embodiment of the present invention.

FIGS. 7*a*-7*c* illustrate graphical plots of the cooling curves for the exemplary embodiment illustrated in FIG. 1. FIG. 7*a* illustrates the combined heat exchangers 114, 116. FIG. 7*b* represents heat exchanger 110. As one can see, withdrawing stream 156 significantly improves the efficiency of the exchanger. FIG. 7*c* illustrates the subcooler exchanger 112.

Figure 8:
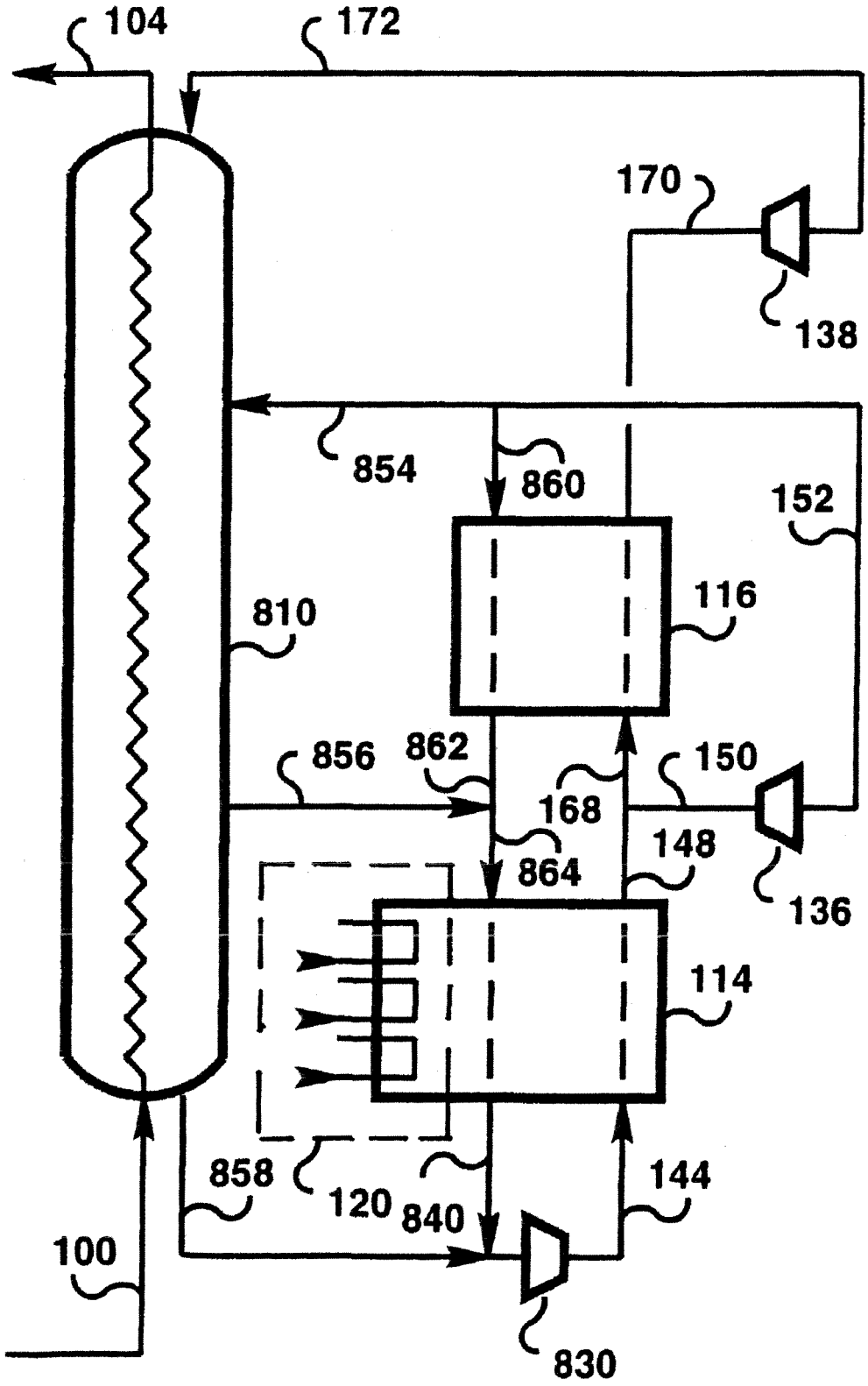
FIG. 8 is a flow chart illustrating an exemplary gas liquefaction system and method involving aspects of the present invention.

In yet another exemplary embodiment, and as illustrated in FIG. 8, a system may be used similar to FIG. 1, however, the gaseous refrigerant may provide refrigeration at only one pressure level. For example, the discharge pressure of Expander 138 may be substantially the same as expander 136. Stream 152 may be split into streams 860 and 854, for example. Stream 854 may be introduced to the shell side of combined liquefier/subcooler exchanger 810 at an intermediate location corresponding to the transition between the liquefying and subcooling sections. There it may mix with warmed-up stream 172. Stream 856 may be withdrawn at an intermediate location within heat exchanger 810 corresponding to the transition between the precooling and liquefying sections, for example. Heat exchanger 810, therefore, may be well balanced, with most refrigerant used in the middle liquefying section.

Stream 860 may be warmed up in heat exchanger 116 to produce stream 862. Stream 862 may be combined with stream 856 to produce stream 864. Stream 864 may be warmed up in heat exchanger 114 to form stream 840, combined with stream 858 from the warm end of heat exchanger 810, and introduced to the suction of refrigerant compressor 830. Compressor 830 may have multiple stages, for example. Again, intercoolers and aftercoolers are not shown for simplicity.

Figure 9:
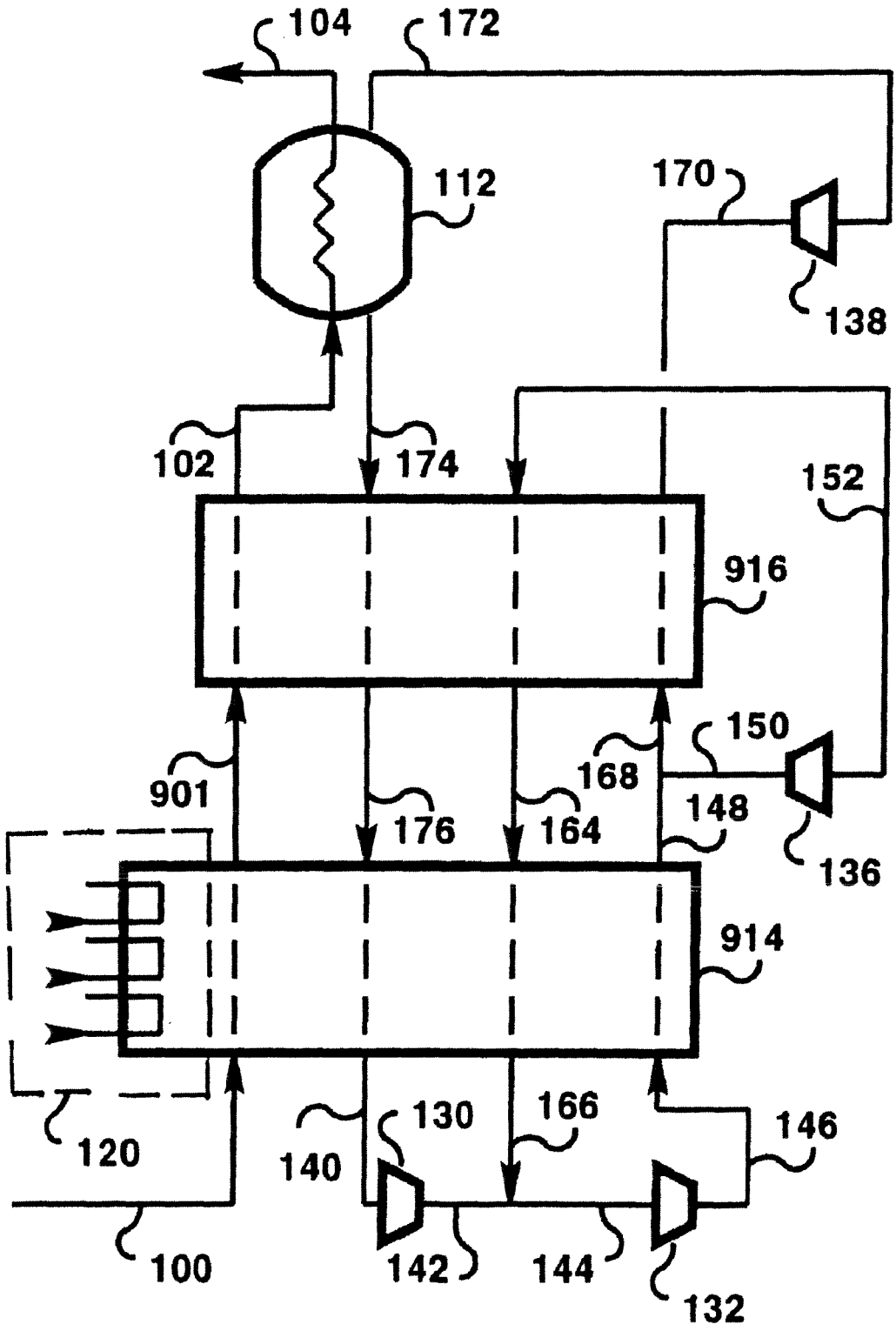
FIG. 9 is a flow chart illustrating an exemplary gas liquefaction system and method involving aspects of the present invention.

In another exemplary embodiment, and as illustrated in FIG. 9, a system may be used similar to FIG. 1, however, the liquefier heat exchanger 110 and heat exchangers 116 and 114 may be combined into heat exchangers 916 and 914. Heat exchangers 914 and 916 may also be combined. Subcooler exchanger 112 may be combined with heat exchanger 916. All three exchangers 914, 916, and 112 can be combined into a single heat exchanger, for example. The feed gas stream 100 may be cooled in the heat exchanger 914 to form stream 901. Stream 901 may be further cooled in heat exchanger 916 to form a substantially liquefied gas stream 102.

Figure 10:
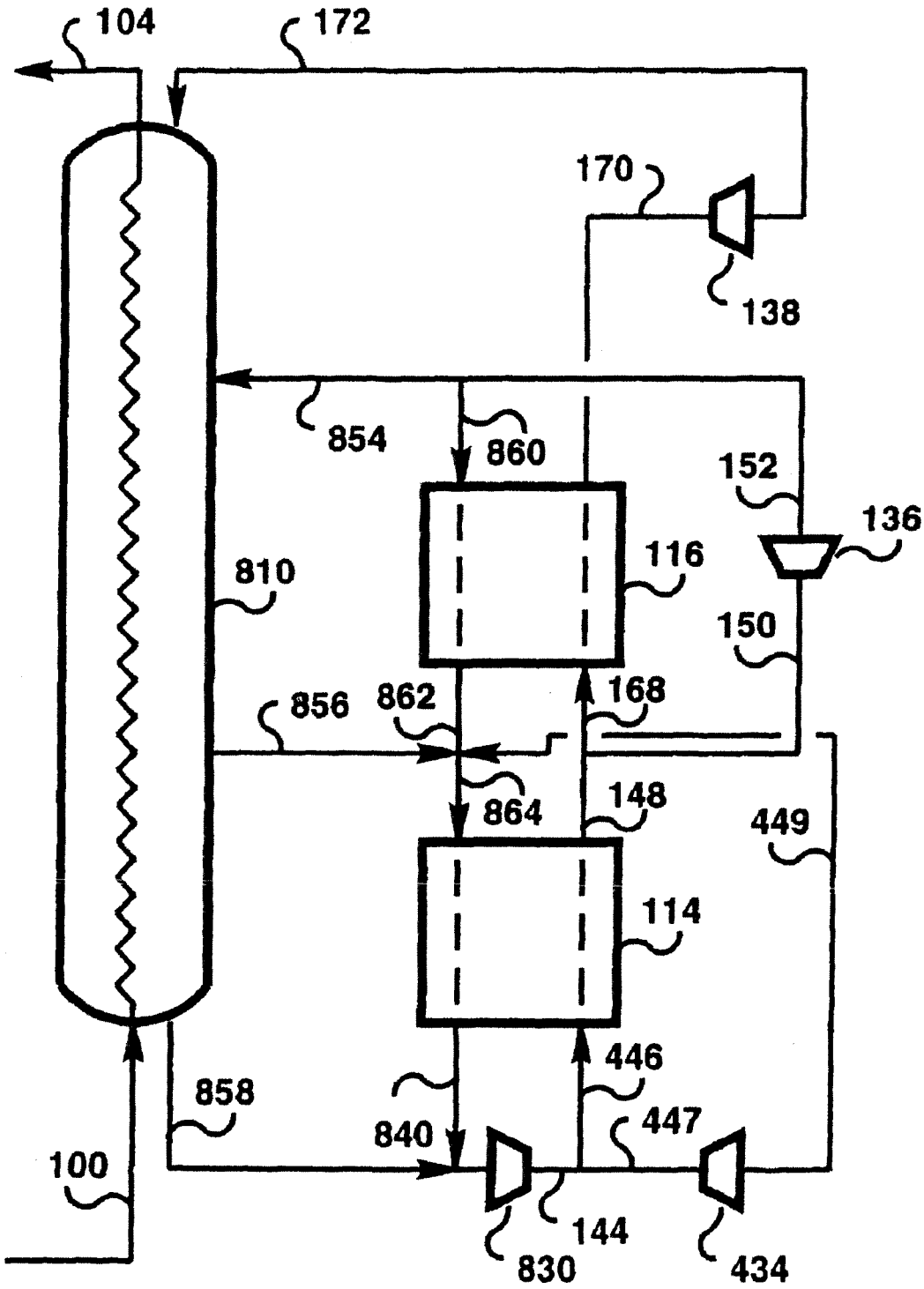
FIG. 10 is a flow chart illustrating an exemplary gas liquefaction system and method involving aspects of the present invention.

In yet another exemplary embodiment, and as illustrated in FIG. 10, a system may be used similar to FIG. 8, however, a third expander 434 may be included as in FIG. 4. The additional expander 434 may replace the refrigeration system 120 in providing the refrigeration for precooling the gaseous refrigerant, in this case stream 447.

Figure 11:
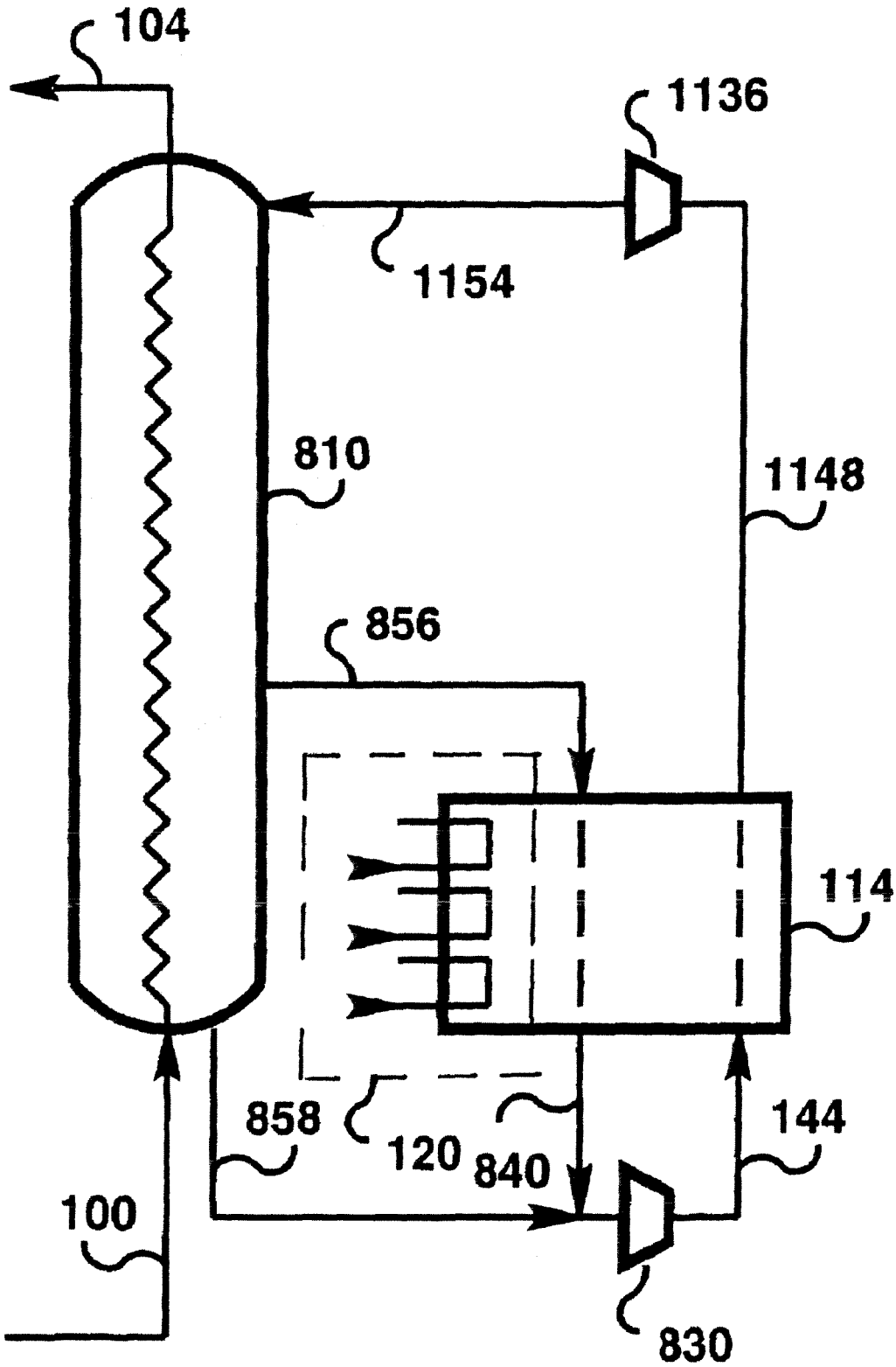
FIG. 11 is a flow chart illustrating an exemplary gas liquefaction system and method involving aspects of the present invention.

In another exemplary embodiment, and as illustrated in FIG. 11, a system may be used similar to FIG. 8, however, the cold expander 138 has been eliminated together with the top section of the liquefier heat exchanger 810. Pre-cooled gaseous refrigerant stream 1148 is expanded in a single expander 1136. Resulting expanded stream 1154 is used to liquefy the natural gas feed 100, for example, in the liquefier heat exchanger 810.

This exemplary embodiment is particularly useful for producing liquid natural gas at warm temperature ranges. These temperature ranges may include, for example, −215° F. to −80° F.

It will be apparent to those skilled in the art that the precooling system 120 in FIG. 1 may be replaced with an additional expander as in FIG. 10, or may be external to the exchanger 114 as in FIG. 2. If two expanders are used, one for pre-cooling, one for liquefaction, they may be discharge at two different pressures with the higher-pressure stream from the warm (pre-cooling) expander introduced between the low-pressure refrigerant compressor and the high-pressure refrigerant compressor as in FIG. 1.

EXAMPLE

Referring to FIG. 3, 3,160 lbmol/hr of natural gas containing approximately 92% of methane, 1.6% of nitrogen, 3.4% of ethane, 2% of propane, and 1% of heavier components at 113° F. and 180 psia (stream 100) was precooled to approximately −31.6° F. by the refrigeration system 320 comprising 3 kettles with vaporization of R134A refrigerant (C2H2F4). The refrigerant was compressed in a 3-stage compressor, as illustrated in FIG. 6. The refrigerant compressor's suction pressure was approximately 0.5 bar absolute. Keeping the suction pressure at vacuum allowed subcooling to a lower temperature. Using a non-flammable refrigerant assured safe operation.

Resulting stream 301 was cooled in the liquefier heat exchanger 310 to −136° F. at which point the stream 102 was all liquid. It was then subcooled in the subcooler exchanger 112 to −261° F. providing resulting stream 104.

Gaseous nitrogen from the discharge of high-pressure refrigerant compressor 132 was at 104° F. and 1,200 psia. Stream 146 was then split into 21,495 lbmol/hr going to refrigeration system 220 and 196,230 lbmol/hr going to combined heat exchangers 214, 116.

Stream 150 resulting from combining streams 249 and 250 entered expander 136 at −49° F. and a flow rate of 164,634 lbmol/hr. It was expanded to about 475 psia at −141° F. (stream 152) and divided into stream 154 entering liquefier heat exchanger 310 at 141,326 lbmol/hr and stream 160 entering combined heat exchangers 214, 116.

Stream 356 left liquefier heat exchanger 310 at −54.4° F. It was then combined with stream 162, warmed up in combined heat exchangers 214, 116 to 97.5° F., and introduced between the low pressure refrigerant compressor 130 and high pressure refrigerant compressor 132 at a flow rate of 164,634 lbmol/hr (stream 166).

Stream 170 entered expander 138 at −136° F. and a flow rate of 53,091 lbmol/hr. Stream 170 was expanded to about 192 psia at −165° F. (stream 172) and then entered subcooler exchanger 112.

Stream 174 left subcooler exchanger 112 at about −140° F. Stream 174 was then warmed up in combined heat exchangers 214, 116 to 97.5° F. and entered the suction of the low pressure refrigerant compressor 130 (stream 140).

While aspects of the present invention has been described in connection with the preferred embodiments of the various figures, it is to be understood that other similar embodiments may be used or modifications and additions may be made to the described embodiment for performing the same function of the present invention without deviating therefrom. Therefore, the claimed invention should not be limited to any single embodiment, but rather should be construed in breadth and scope in accordance with the appended claims.

The invention claimed is:

1. A method of liquefaction using a closed loop refrigeration system, the method comprising the steps of:

(a) compressing a gaseous refrigerant stream in at least one compressor;

(b) cooling at least a portion of the compressed gaseous refrigerant stream in a first heat exchanger;

(c) expanding a first portion of the cooled, compressed gaseous refrigerant stream from the first heat exchanger in a first expander to provide a first expanded gaseous refrigerant stream;

(d) cooling and substantially liquefying a feed gas stream to form a substantially liquefied feed gas stream in a second heat exchanger through indirect heat exchange against the first portion of the first expanded gaseous refrigerant stream from the first expander; and (e) further cooling a second portion of the cooled, compressed gaseous refrigerant stream from the first heat exchanger in a third heat exchanger by indirect heat exchange with a second portion of the first expanded gaseous refrigerant stream from the first expander, wherein the first expanded gaseous refrigerant stream exiting the first expander is substantially vapor.

2. The method of claim 1, further comprising subcooling the cooled and substantially liquefied feed gas stream through indirect heat exchange in a subcooler exchanger against a second expanded gaseous refrigerant stream exiting a second expander.

3. The method of claim 2, wherein the second portion of the cooled, compressed gaseous refrigerant stream, after being further cooled in the third heat exchanger, is fed to the second expander to provide the second expanded gaseous refrigerant stream.

4. The method of claim 3, wherein the second expanded gaseous refrigerant stream exiting the second expander is substantially vapor.

5. The method of claim 4, wherein the second expanded gaseous refrigerant stream exiting the subcooler exchanger is compressed in a low pressure compressor; combined with the first portion of the first expanded gaseous refrigerant stream exiting the second heat exchanger and the second portion of the first expanded gaseous refrigerant stream exiting the third heat exchanger; and the mixed stream further compressed in a high pressure compressor.

6. The method of claim 1, further comprising warming at least a portion of the first portion of the first expanded gaseous refrigerant stream exiting the second heat exchanger in the first heat exchanger.

7. The method of claim 1, further comprising warming the second portion of the first expanded gaseous refrigerant stream exiting the third heat exchanger in the first heat exchanger.

8. The method of claim 1, further comprising splitting the compressed gaseous refrigerant stream exiting the at least one compressor into a first portion and a second portion, cooling said first portion in a supplemental refrigeration system that comprises at least one stage of a vaporizing liquid refrigerant, cooling said second portion in the first heat exchanger in step (b) of claim 1, and combining the cooled first portion with a portion of the cooled second portion for expansion in the first expander in step (c) of claim 1.

9. The method of claim 1, further comprising splitting the compressed gaseous refrigerant stream exiting the at least one compressor into a first portion and a second portion, expanding said first portion in a third expander, warming the resultant expanded first portion in the first heat exchanger, and cooling said second portion in the first heat exchanger in step (b) of claim 1.

10. The method of claim 1, wherein the feed gas stream for liquefaction is a natural gas stream.

11. The method of claim 1, wherein the gaseous refrigerant stream is a nitrogen stream.

12. A closed loop system for liquefaction comprising:

a refrigeration circuit, the refrigeration circuit comprising:

a first compressor;

A first heat exchanger fluidly coupled to the first compressor and adapted to accept a gaseous refrigerant stream from the first compressor;

a first expander fluidly coupled to the first heat exchanger and adapted to accept a first stream of refrigerant from the first heat exchanger;

a second heat exchanger fluidly coupled to the first expander and adapted to accept a first expanded gaseous refrigerant stream from the first expander and a feed gas stream;

a third heat exchanger fluidly coupled to the first heat exchanger and to the first expander and adapted to accept a second stream of refrigerant from the first heat exchanger and a second expanded gaseous refrigerant stream from the first expander;

a second expander fluidly coupled to the third heat exchanger and adapted to accept a stream of refrigerant from the third heat exchanger; and a subcooler exchanger fluidly coupled to the second heat exchanger and the second expander and adapted for acceptance of the feed gas stream from the second heat exchanger and an expanded gaseous refrigerant stream from the second expander, wherein the first heat exchanger and the third heat exchanger may be combined into one heat exchanger, and wherein the second heat exchanger and the subcooler exchanger may be combined into one heat exchanger.

13. A method of liquefaction using a closed loop refrigeration system, the method comprising the steps of:

(a) compressing a gaseous refrigerant stream in at least one compressor;

(b) cooling at least a portion of the compressed gaseous refrigerant stream in a first heat exchanger;

(c) removing from an intermediate section of the first heat exchanger a cooled, compressed gaseous refrigerant stream and expanding said portion of the cooled, compressed gaseous refrigerant stream from the first heat exchanger in a first expander to provide a first expanded gaseous refrigerant stream;

(d) cooling and substantially liquefying a feed gas stream to form a substantially liquefied feed gas stream in a second heat exchanger through indirect heat exchange against the first portion of the first expanded gaseous refrigerant stream from the first expander; and (e) further cooling a second portion of the cooled, compressed gaseous refrigerant stream in the first heat exchanger by indirect heat exchange with a second portion of the first expanded gaseous refrigerant stream from the first expander, wherein the first expanded gaseous refrigerant stream exiting the first expander is substantially vapor.

14. The method of claim 13, further comprising subcooling the cooled and substantially liquefied feed gas stream through indirect heat exchange in the second exchanger against a second expanded gaseous refrigerant stream exiting a second expander.

15. The method of claim 14, wherein the second portion of the cooled, compressed gaseous refrigerant stream, after being further cooled in the first heat exchanger, is fed to the second expander to provide the second expanded gaseous refrigerant stream.

16. The method of claim 15, wherein the second expanded gaseous refrigerant stream exiting the second expander is substantially vapor.

17. The method of claim 13, further comprising subcooling the cooled and substantially liquefied feed gas stream through indirect heat exchange in a subcooler exchanger against a second expanded gaseous refrigerant stream exiting a second expander.

18. The method of claim 13, wherein the feed gas stream for liquefaction is a natural gas stream.

19. The method of claim 13, wherein the gaseous refrigerant stream is a nitrogen stream.

20. A closed loop system for liquefaction, comprising:

a refrigeration circuit, the refrigeration circuit comprising:

a first compressor;

a first heat exchanger fluidly coupled to the first compressor and adapted to accept a compressed gaseous refrigerant stream from the first compressor;

a first expander fluidly coupled to the first heat exchanger and adapted to accept a first portion of the cooled, compressed gaseous refrigerant stream from an intermediate location of the first heat exchanger;

a second heat exchanger fluidly coupled to the first expander and adapted to accept a first expanded gaseous refrigerant stream from the first expander and a feed gas stream;

a second expander fluidly coupled to the first heat exchanger and adapted to accept a second portion of the cooled, compressed gaseous refrigerant stream from the first heat exchanger;

wherein the first heat exchanger is adapted to accept a second expanded gaseous refrigerant stream from the first expander, and wherein the second heat exchanger is adapted to receive an expanded gaseous refrigerant stream from the second expander.

* * * * *